US011639629B2

(12) United States Patent
Siebenahler

(10) Patent No.: US 11,639,629 B2
(45) Date of Patent: May 2, 2023

(54) ATTIC DOOR SUPPORT AND TRIMMING SYSTEM

(71) Applicant: Lyle M. Siebenahler, Pipestone, MN (US)

(72) Inventor: Lyle M. Siebenahler, Pipestone, MN (US)

( * ) Notice: Subject to any disclaimer, the term of this patent is extended or adjusted under 35 U.S.C. 154(b) by 0 days.

(21) Appl. No.: 17/474,712

(22) Filed: Sep. 14, 2021

(65) Prior Publication Data

US 2023/0084857 A1 Mar. 16, 2023

(51) Int. Cl.

| | |
|---|---|
| ***E06B 1/52*** | (2006.01) |
| ***E06B 5/01*** | (2006.01) |
| ***E04C 2/40*** | (2006.01) |
| ***E04B 9/00*** | (2006.01) |
| *E06B 3/964* | (2006.01) |

(52) U.S. Cl.

CPC ..... *E06B 5/01* (2013.01); *E04B 9/003* (2013.01); *E06B 1/52* (2013.01); *E04C 2/40* (2013.01); *E06B 3/9645* (2013.01); *E06B 3/9646* (2013.01)

(58) Field of Classification Search

CPC ..... E06B 5/01; E06B 1/52; E06B 5/00; E06B 3/7015; E06B 1/76; E06B 3/9646; E06B 3/9645; E06B 1/20; E06B 1/603; E04B 9/003; E04F 19/08; E04F 21/0007; E04F 2201/041; E04C 2/40; E04C 2003/0456

See application file for complete search history.

(56) References Cited

U.S. PATENT DOCUMENTS

| | | | | | |
|---|---|---|---|---|---|
| 1,142,311 | A * | 6/1915 | Crandall | E06B 9/522 | 160/374 |
| 2,031,875 | A * | 2/1936 | Dobie | E06B 3/2605 | 49/440 |
| 2,719,585 | A * | 10/1955 | Sylvan | E06B 3/2605 | 160/90 |
| 3,301,820 | A * | 1/1967 | Haendiges | E06B 7/00 | 206/325 |
| 4,151,894 | A * | 5/1979 | Edwards | E06B 5/01 | 182/47 |
| 4,593,493 | A | 6/1986 | Naka | | |
| 4,944,126 | A * | 7/1990 | King | E04D 13/16 | 182/47 |
| 5,475,955 | A * | 12/1995 | Dickinson | E04F 11/064 | 52/186 |
| 6,578,327 | B1 | 6/2003 | Hackbarth | | |
| 6,625,933 | B1 * | 9/2003 | Moeller | E06B 7/16 | 49/489.1 |
| 6,701,676 | B1 | 3/2004 | Kompelien | | |
| 7,836,638 | B2 | 11/2010 | Ogieglo | | |

(Continued)

*Primary Examiner* — Phi D A

(57) ABSTRACT

An attic door support and trimming system includes a plurality of frame sections each having a base wall with an inner edge, an outer edge, a top side and a bottom side, a first end and a second end. A vertical wall extends upwardly from the base wall and is spaced from the inner and outer edges. The first and second ends of different frame sections are positionable against each other to form a rectangular shaped frame. The frame sections each are telescopic to allow a size of the rectangular shaped frame to be adjusted. The top side of the first flange is abuttable against the ceiling adjacent to the opening and the top of the second flange supports a cover when the cover is placed in a closed position closing the opening.

9 Claims, 9 Drawing Sheets

(56) References Cited

U.S. PATENT DOCUMENTS

| | | | | |
|---|---|---|---|---|
| 8,117,786 | B1 * | 2/2012 | Tobbe | E06B 5/01 52/220.8 |
| 8,438,789 | B2 | 5/2013 | Uhl | |
| 9,803,416 | B2 | 10/2017 | Melesky | |
| 10,829,985 | B2 | 11/2020 | Jejina | |

* cited by examiner

ATTIC DOOR SUPPORT AND TRIMMING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ceiling opening trim structure and more particularly pertains to a new ceiling opening trim structure for providing trim around an attic doorway while further providing a support flange to hold and support a closure for the attic doorway.

(2) Description of Related Art Including Information Disclosed Under 37 CFR 1.97 and 1.98

The prior art relates to ceiling opening trim and door structures that are typically pre-fabricated as an entire unit. While this may ease installation of an entire structure, such structures cannot be modified to custom open and must be precisely fit within an opening.

BRIEF SUMMARY OF THE INVENTION

An embodiment of the disclosure meets the needs presented above by generally comprising a plurality of frame sections each having a base wall with an inner edge, an outer edge, a top side and a bottom side, a first end and a second end. A vertical wall is attached to and extends upwardly from the base wall. The vertical wall is spaced from the inner and outer edges to define a first flange positioned between the vertical wall and the outer edge and a second flange positioned between the vertical wall and the inner edge. The vertical wall forms an angle with the base wall that is between 80° and 100°. The first ends of the frame sections are positionable against the second ends of other frame sections such that the frame sections form a rectangular shaped frame. The frame sections each are telescopic to allow a size of the rectangular shaped frame to be adjusted such that the vertical walls of the frame sections encompass and form a boundary around an opening in a ceiling. The top side of the first flange is abuttable against the ceiling adjacent to the opening and the top of the second flange supports a cover when the cover is placed in a closed position closing the opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
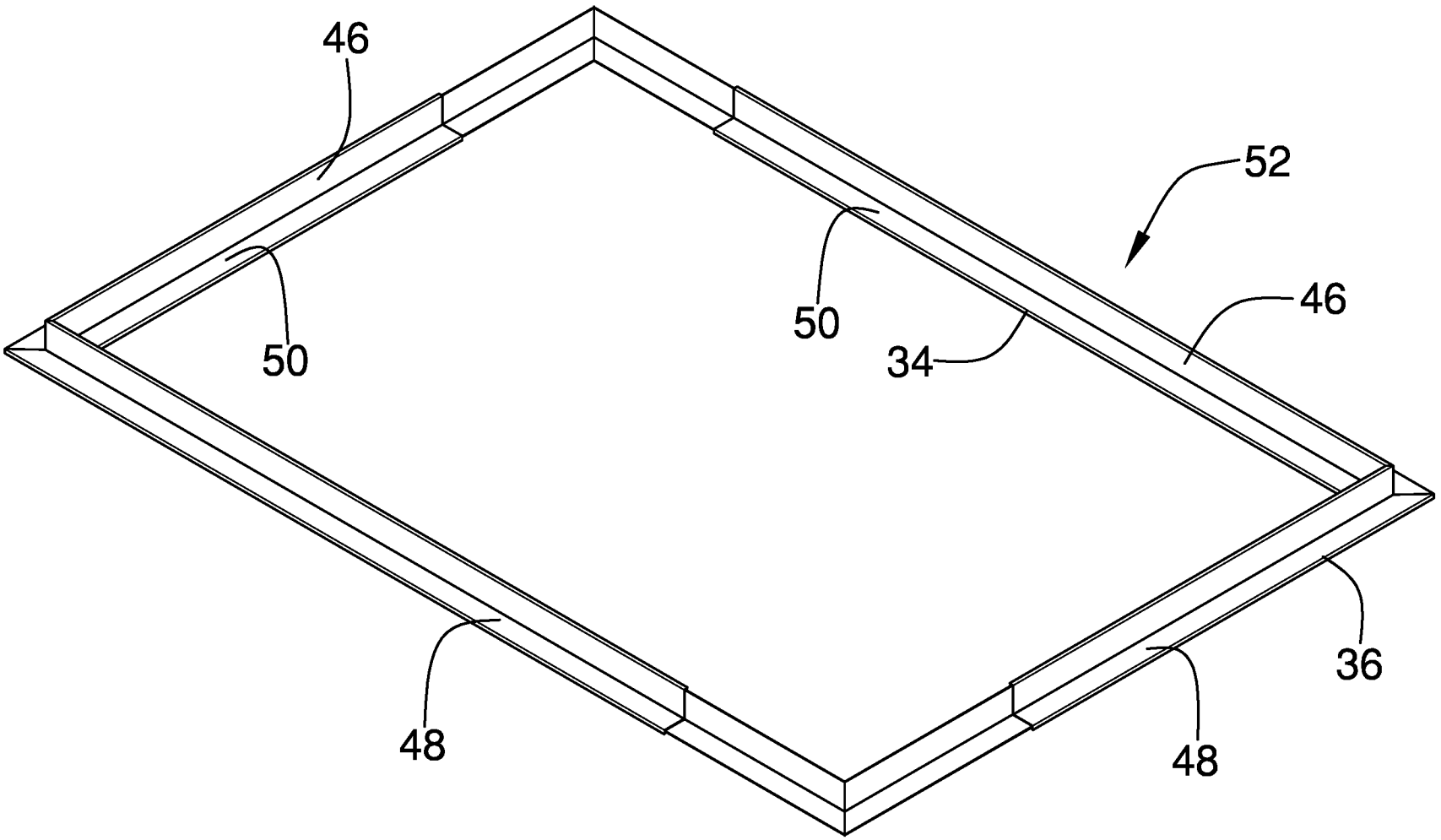
FIG. 1 is a top isometric view of an attic door support and trimming system according to an embodiment of the disclosure.

With reference now to the drawings, and in particular to FIGS. 1 through 9 thereof, a new ceiling opening trim structure embodying the principles and concepts of an embodiment of the disclosure and generally designated by the reference numeral 10 will be described.

As best illustrated in FIGS. 1 through 9, the attic door support and trimming system 10 generally comprises an assembly and method to be used supporting a cover 12 for an opening 14 in a ceiling 16 formed by an attic doorway 18. Typically, the "doorway" would be a rectangular box frame used to form the opening 14 that allows access to an attic or crawl space accessible upwardly through the ceiling 16. The system 10 described herein includes an inwardly extending flange 22 bounding the opening 14 so that a cover 12, or door, is positionable on the inwardly extending flange 22 and thereby supported in place. Typically, such openings 14 included a rough edge 26 of the ceiling 16 where the ceiling 16 meets the attic doorway 18. In some examples the ceiling 16 may be comprised of drywall (also known as plasterboard, sheet rock, wallboard, etc.) having an exposed edge that would typically not be sanded and textured but instead is covered by trim. The system 10 herein further creates an outwardly extending flange 24 to extend over the exposed edge and function as trim.

The system 10, more specifically, includes a plurality of frame sections 30. Each of the frame sections 30 has a base wall 32 having an inner edge 34, an outer edge 36, a top side 38, a bottom side 40, a first end 42 and a second end 44. A vertical wall 46 is attached to and extends upwardly from the base wall 32. The vertical wall 46 is spaced from the inner 34 and outer 34 edges to define a first flange 48 positioned between the vertical wall 46 and the outer edge 36 and a second flange 50 positioned between the vertical wall 46 and the inner edge 34. The vertical wall 46 is substantially perpendicular to the base wall 32 and will typically form an angle with the base wall 32 that is between 80° and 100°, and more often will form an angle between 85° and 95°.

Figure 2:
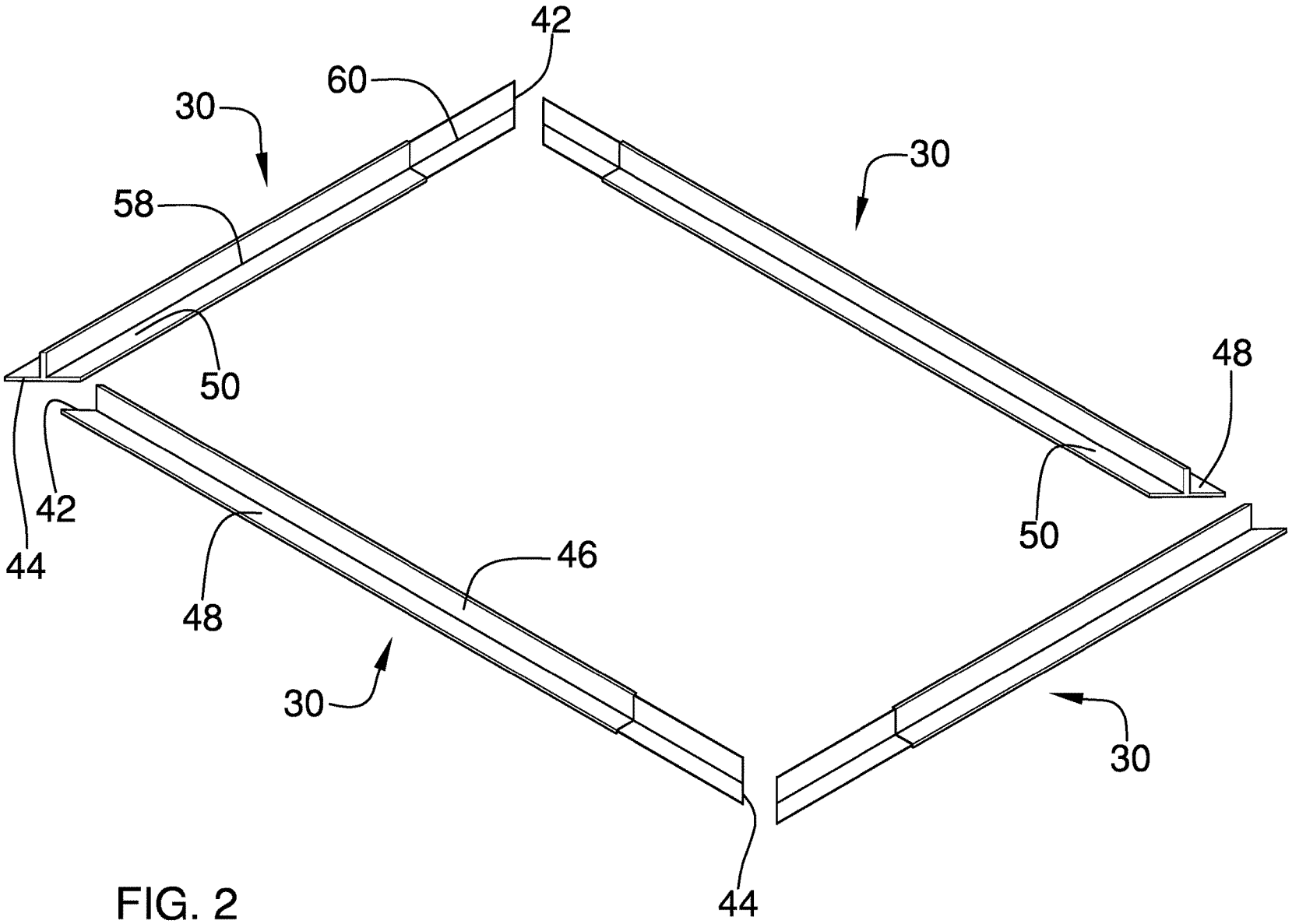
FIG. 2 is a top isometric view of an embodiment of the disclosure.
Figure 3:
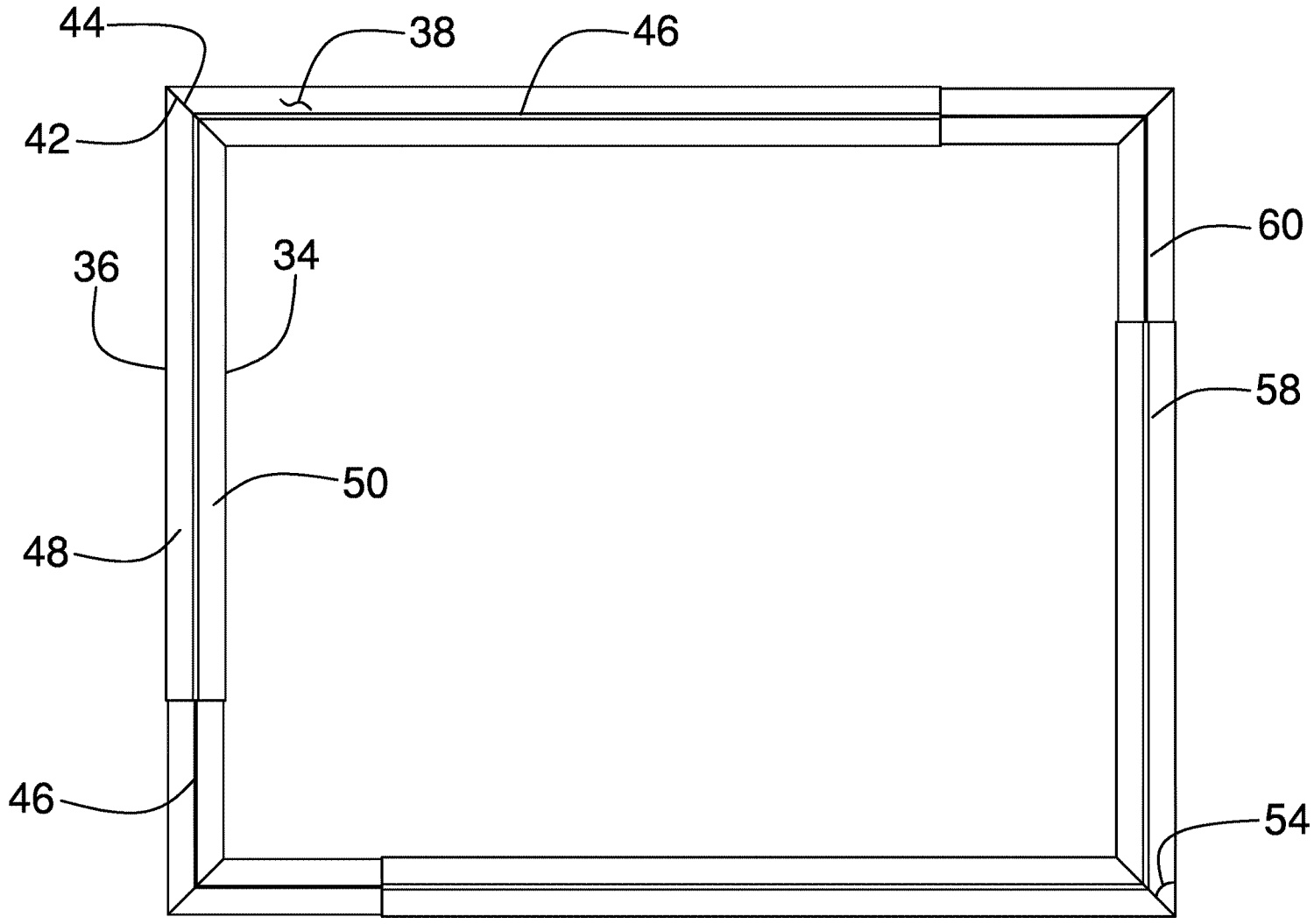
FIG. 3 is a top view of an embodiment of the disclosure.
Figure 4:
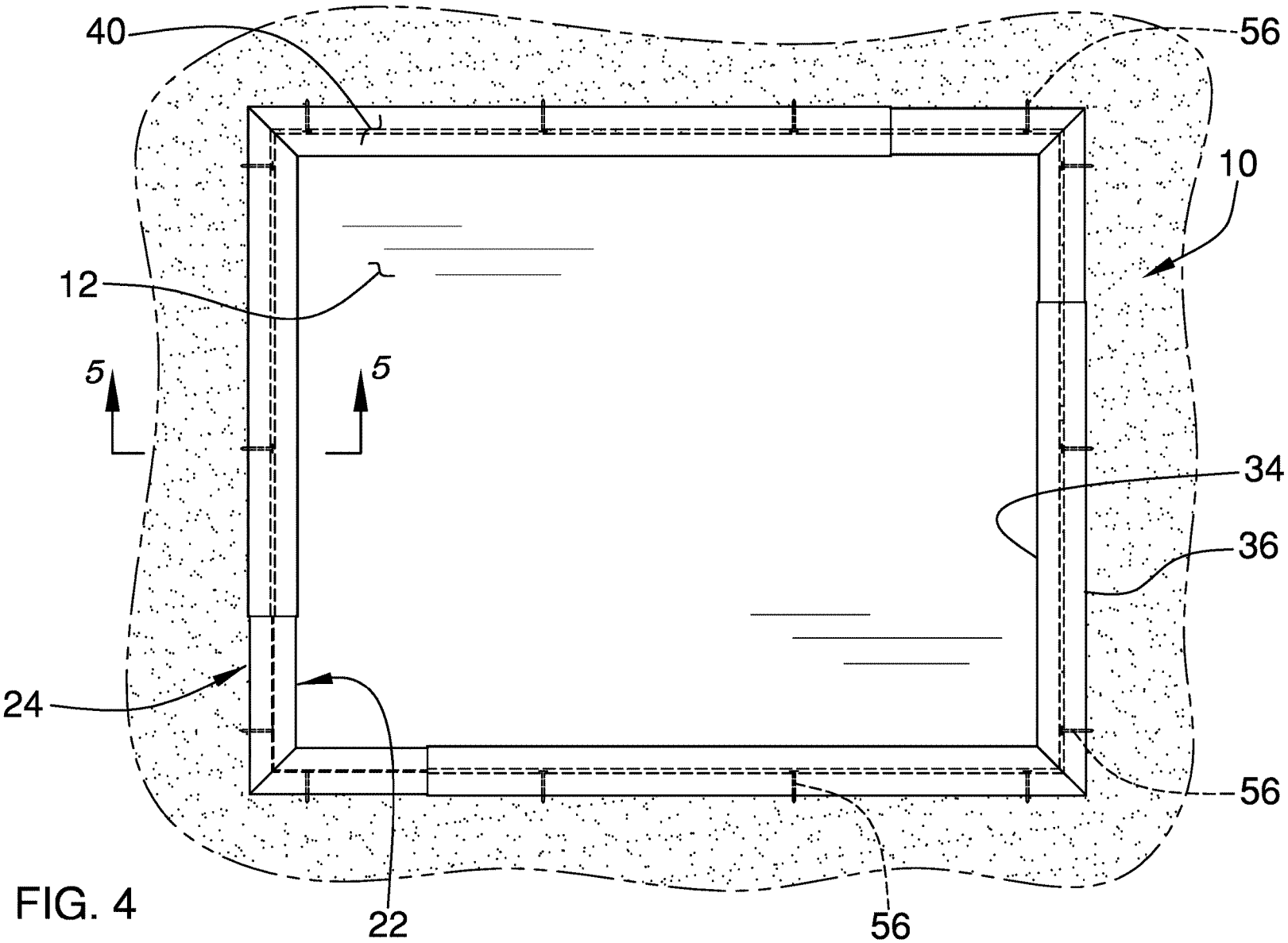
FIG. 4 is a bottom view of an embodiment of the disclosure.

The first ends 42 of the frame sections 30 are positionable against the second ends 44 of other frame sections 30 such that the frame sections 30 form a rectangular shaped frame 52 as shown in FIG. 1. As the opening 14 in the ceiling 16 is most often rectangular, the opening 14 will thereby match the shape of the rectangular shaped frame 52. In one embodiment to facilitate the abutment of the first 42 and second 44 ends together, each of the first 42 and second 44 ends may form a 45° angle 54 with a corresponding one of the outer edges 36. Since each first 42 and second 44 end will have a same angle, the first 42 and second 42 ends can be joined together at a 90° angle. In this embodiment, the frame sections 30 may comprise four frame sections 30 each being elongated and linear as shown in FIG. 2. However, it should be readily apparent that different numbers of frame sections 30 may utilized such as two frame sections 30 wherein each frame section includes a 90° bend but still utilizing 45° angled first 42 and second ends 44. While other angles may be used that form 90° connections such as a 30° first end and a 60° second end, the 45° angle may be most preferred as it will be aesthetically pleasing. Alternatively, each may form a 90° angle with the outer edge 36 wherein the first ends 42 are abutted against the inner edges 34 and the second ends 44 are free, though such a structure would leave an "unfinished" appearance and would be less favored.

The frame sections 30 are each telescopic to allow a size of the rectangular shaped frame 52 to be adjusted such that the vertical walls 46 of the frame sections encompass and form a boundary around the opening 14 in the ceiling 16. The top side 38 of the first flange 48 is abuttable against the ceiling 16 adjacent to the opening 14. Thus, the first flange 48 forms trim extending around and outwardly from the opening 14. This frees the top of the second flange 50 to support the cover 12 when the cover 12 is placed in a closed position closing the opening 14.

To secure the frame sections 30 in place, a plurality of fasteners 56 extends through each of the vertical walls 46 and into the attic doorway 18. The fasteners 56 may comprise nails, screws or other conventional mechanical fasteners used with wood and metal frames. This further ensures that the frame sections 30 are maintained in abutment with each other to maintain the appearance of continuous trim extending around the opening 14.

Figure 5:
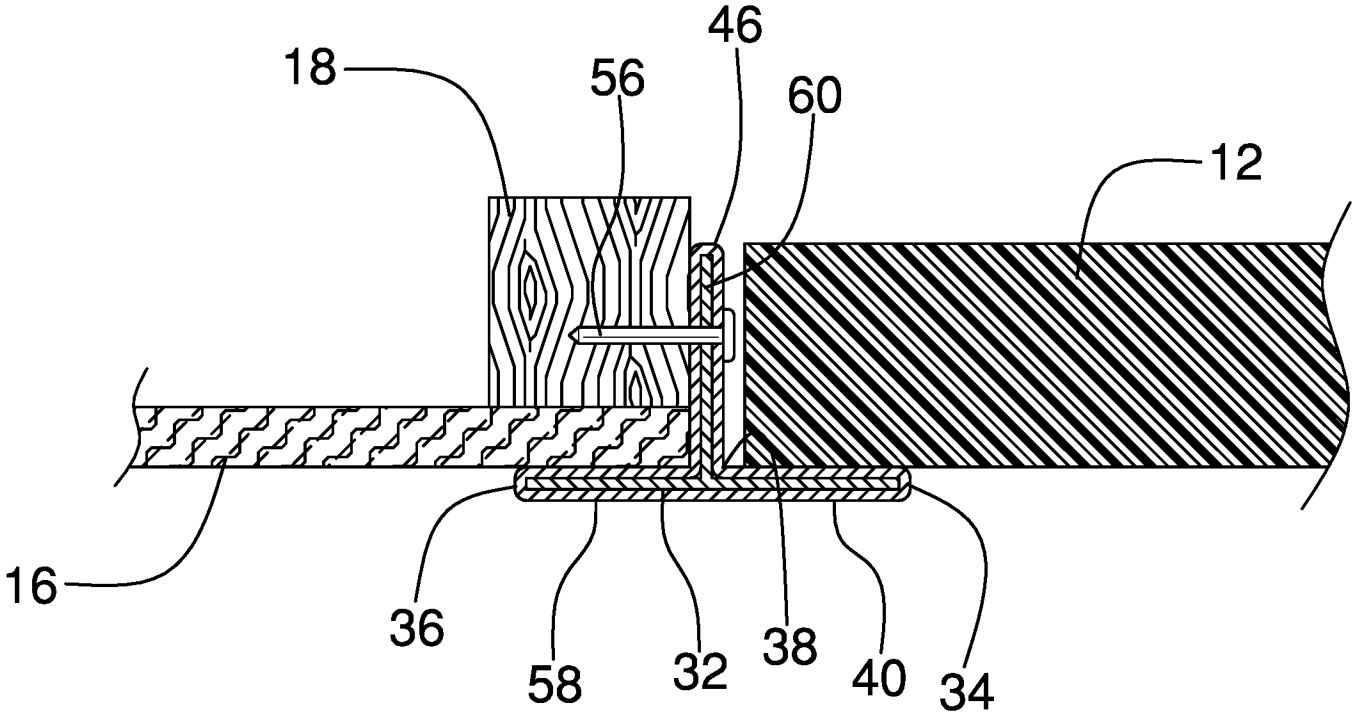
FIG. 5 is a cross-sectional view of an embodiment of the disclosure taken along line 5-5 of FIG. 4.

As should be readily apparent from the Figures, each of the frame sections 30 consists of a first member 58 and a second member 60 telescopically engaged with each other to alter a length of the frame sections 30 from the first end 42 to the second end 44. While each frame sections 30 could include a greater number of members telescopically engaged with each other, such a structure would increase height of the base wall 32 to such an extent as to provide aesthetically poor trim. FIG. 5 shows an embodiment of a frame section 30 wherein the first member 58 entirely extends around an outer periphery of the second member 60. Such an embodiment may be comprised of any material that is relatively rigid or resiliently bendable such as, for example, metals and plastics.

Figure 6:
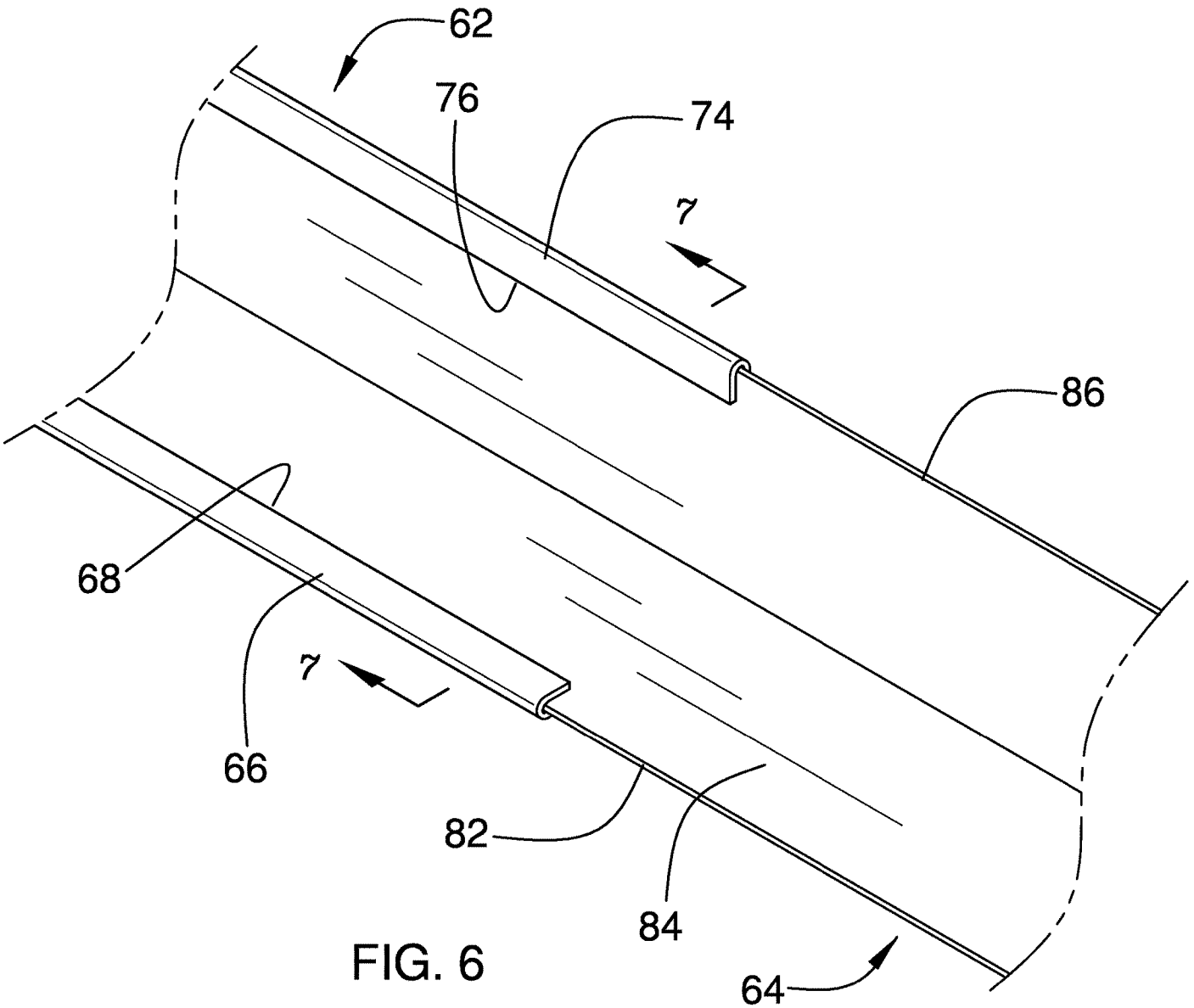
FIG. 6 is a side isometric view of another embodiment of the disclosure.
Figure 7:
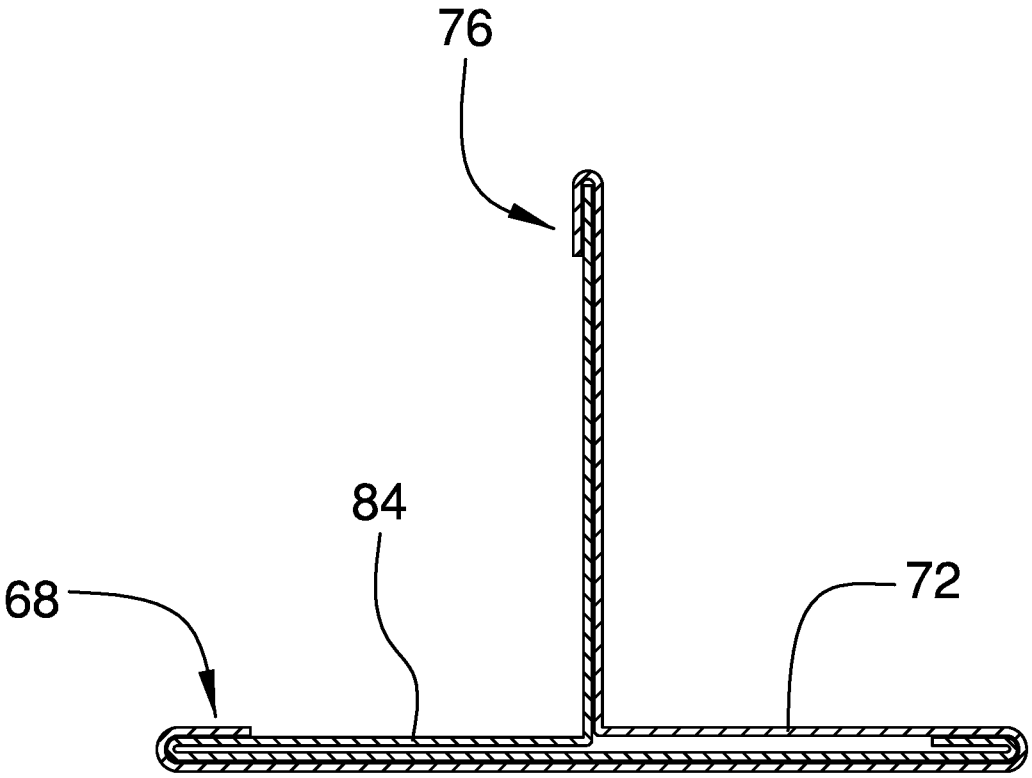
FIG. 7 is a cross-sectional view of an embodiment of the disclosure taken along line 7-7 of FIG. 6.
Figure 8:
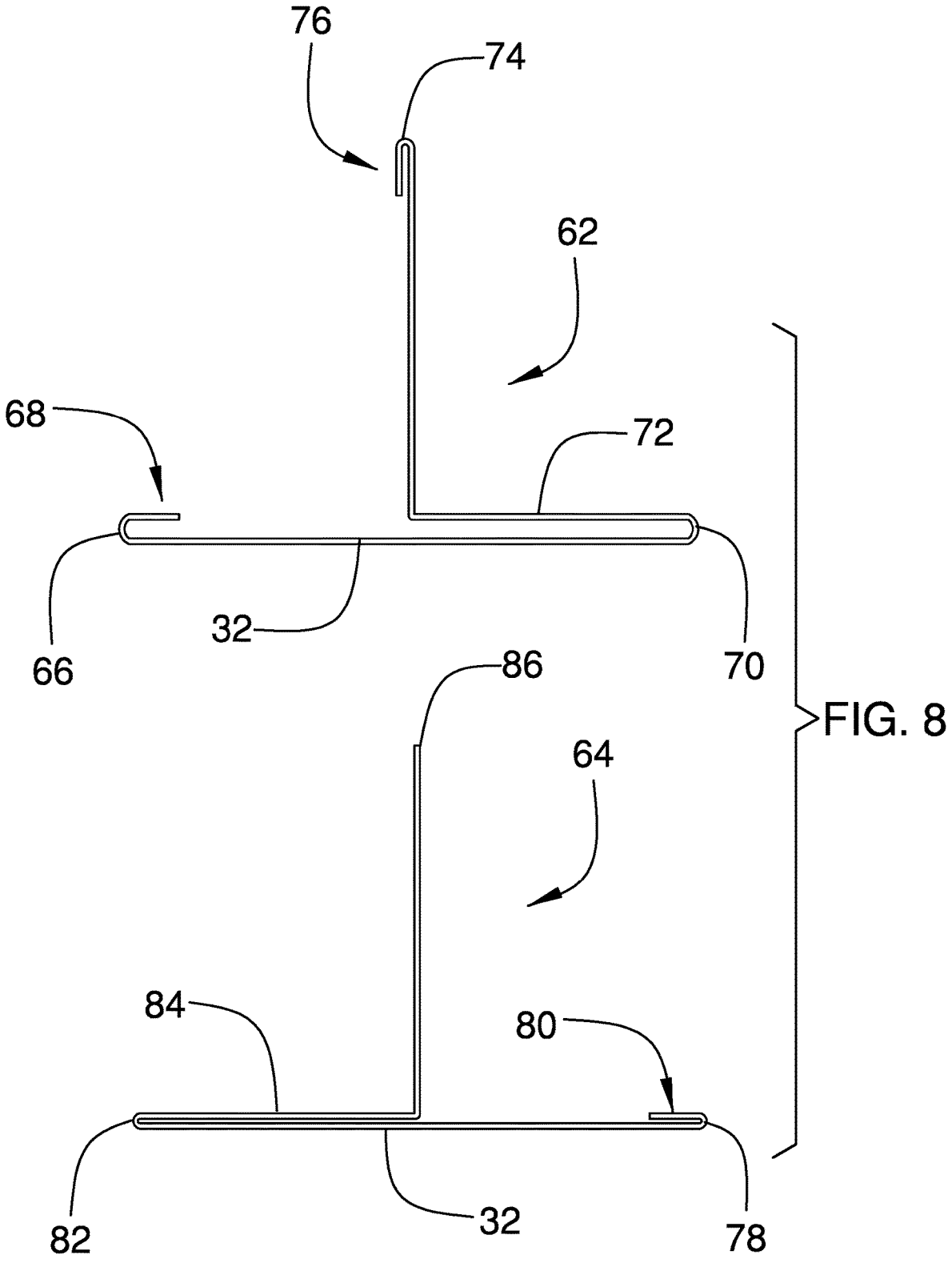
FIG. 8 is an exploded end view of the embodiment of the disclosure depicted in FIG. 6.
Figure 9:
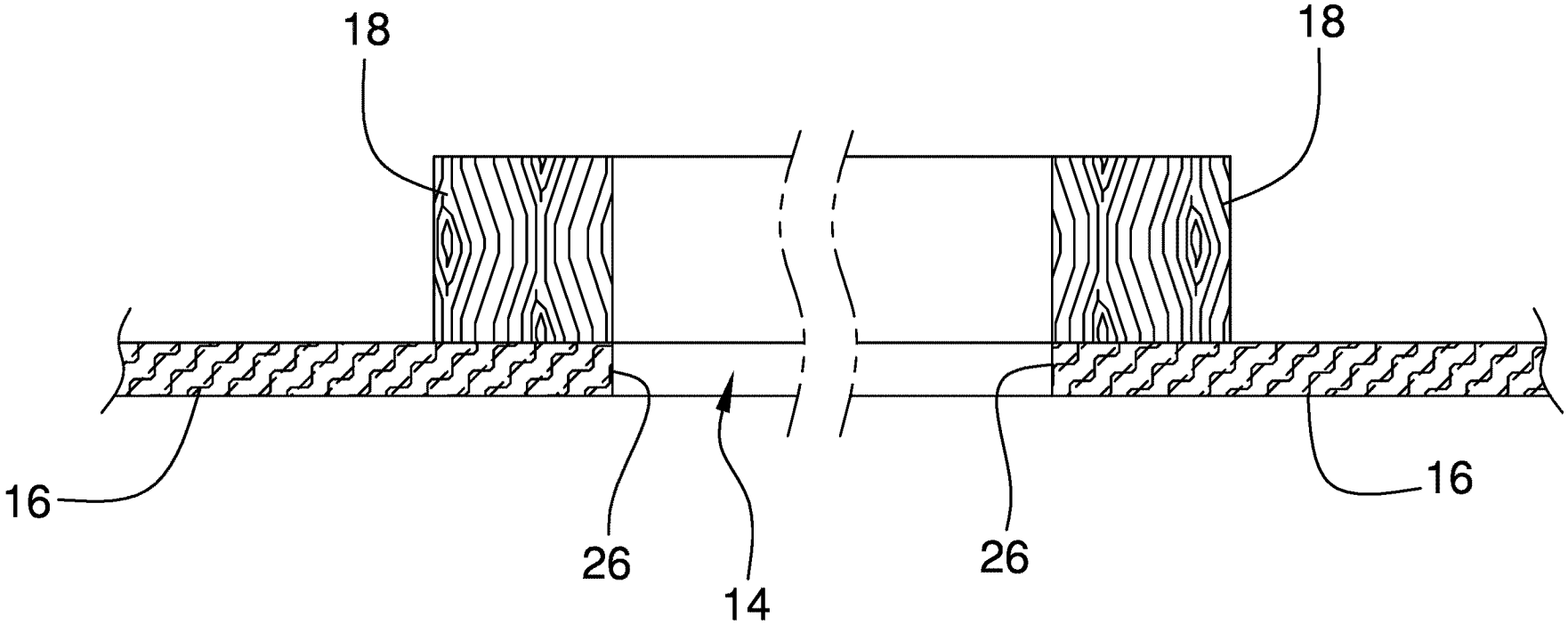
FIG. 9 is a cross-section of an embodiment of an attic opening.

FIGS. 6-8 depict another embodiment wherein the first 62 and second 64 members are each formed of a single panel of material wherein the panels are folded to form the base 32 and vertical 46 walls. In this embodiment, the first member 62 need not extend completely around the second member 64. Utilizing a panel to form the first member 62 and a panel to form the second member 64 provides ease of manufacture as the panels can be comprised of a bendable metallic material, such as aluminum, copper, lead and the like, which are bent to form the first 62 and second 64 members. As can be seen in FIG. 7, the first member 62 is bent to form a base wall 32 having a first lateral edge 66 creating a first lateral hook 68, a nearly 360° bend to form the second lateral edge 70 and to cause the material to fold over to itself approximately half way between the first 66 and second 70 lateral edges. The folded over section 72 then having a bend therein to extend the material upwardly from the base wall 32 and then an upper edge 74 terminating in a downwardly extending hook 76. The second member 64 includes a base wall 32 with its second lateral edge 78 comprising a second lateral hook 80, its first lateral edge 82 having a bend to extend the material over itself toward the second lateral edge 78, and then finally a bend in the folded over section 84 to extend the remaining material upwardly and terminating with a straight edge 86. As shown in FIG. 7, the first lateral edge 82 of the second member 64 is extended under the first lateral hook 68 of the first member 62, the straight edge 86 of the second member 64 is extended into the downwardly extending hook 76, and the second lateral hook 80 is extended under folded over section 72 of the first member 62. This structure allows the first 62 and second 64 members to slide telescopically relative to each other while retaining a very low profile due to the ability to utilize very thin sheet metal. Moreover, the second lateral hook 80 places tension on folder over section 72 to provide some resistance to unwanted movement between the first 62 and second 64 members.

The size of the frame sections 30 may vary depending on the required usage and the tastes of the user. Generally, the frame sections 30 include a base wall 32 having a width from inner edge to outer edge between 1.0 inches and 4.0 inches and a vertical wall 46 having a height between 1.0 inches and 4.0 inches. The frame sections 30, when extended to their full telescoped length, typically have a length between 18.0 inches and 60.0 inches. It should be further understood that though the bottom side 40 of the base wall 32 is shown as being planar in the Figures, it may include embellishments and raised steps to enhance the visual appearance of the finished rectangular shaped frame 52.

In use, the system 10 provides a support for the covering 12 of the attic opening 14 while also functioning as trim. However, the telescopic nature of the frame sections 30 and, in some embodiments, the first 42 and second 44 ends being angled, allows for extremely quick installation which is not possible when custom cutting trim pieces and support flanges for an attic doorway 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An attic opening framing system for supporting a cover for an opening in a ceiling formed by an attic doorway and for covering a juncture of the ceiling and the attic doorway, the system comprising:

a plurality of frame sections, each of the frame sections having a base wall having an inner edge, an outer edge, a top side and a bottom side, a first end and a second end, a vertical wall being attached to and extending upwardly from the base wall, the vertical wall being between and spaced from the inner and outer edges to define a first flange positioned between the vertical wall and the outer edge and a second flange positioned between the vertical wall and the inner edge, the vertical wall forming an angle with the base wall being between 80° and 100°;

the first ends of the frame sections being positionable against the second ends of other frame sections such that the frame sections form a rectangular shaped frame; and the frame sections each being telescopic to allow a size of the rectangular shaped frame to be adjusted such that the vertical walls of the frame sections encompass and form a boundary around the opening in the ceiling, the top side of the first flange being abuttable against the ceiling adjacent to the opening, the top of the second flange supporting the cover when the cover is placed in a closed position closing the opening.

2. The attic opening framing system according to claim 1, wherein the first and second ends each form a 45° angle with a corresponding one of the outer edges.

3. The attic opening framing system according to claim 1, wherein the frame sections comprise four frame sections.

4. The attic opening framing system according to claim 1, further including a plurality of fasteners extending through each of the vertical walls and into the attic doorway to retain the frame sections in abutment with each other.

5. The attic opening framing system according to claim 1, wherein each of the frame sections consists of a first member and a second member telescopically engaged with each other.

6. The attic opening framing system according to claim 5, wherein each of the first and second members is formed of a single panel of material being folded to form each of the base and vertical walls.

7. An attic opening framing system for supporting a cover for an opening in a ceiling formed by an attic doorway and covering a juncture of the ceiling and the attic doorway, the system comprising:

a plurality of frame sections, each of the frame sections having a base wall having an inner edge, an outer edge, a top side and a bottom side, a first end and a second end, a vertical wall being attached to and extending upwardly from the base wall, the vertical wall being between and spaced from the inner and outer edges to define a first flange positioned between the vertical wall and the outer edge and a second flange positioned between the vertical wall and the inner edge, the vertical wall forming an angle with the base wall being between 80° and 100°;

the first and second ends each forming a 45° angle with a corresponding one of the outer edges;

the first ends of the frame sections being positionable against the second ends of other frame sections such that the frame sections form a rectangular shaped frame;

the frame sections each being telescopic to allow a size of the rectangular shaped frame to be adjusted such that the vertical wads of the frame sections encompass and form a boundary around the opening in the ceiling, the top side of the first flange being abuttable against the ceiling adjacent to the opening, the top of the second flange supporting the cover when the cover is placed in a closed position closing the opening;

the frame sections comprising four frame sections; and a plurality of fasteners extending through each of the vertical walls and into the attic doorway to retain the frame sections in abutment with each other.

8. The attic opening framing system according to claim 1, wherein each of the frame sections consists of a first member and a second member telescopically engaged with each other.

9. The attic opening framing system according to claim 5, wherein each of the first and second members is formed of a single panel of material being folded to form each of the base and vertical walls.

* * * * *